US011142840B2

(12) United States Patent
Jonnalagadda et al.

(10) Patent No.: US 11,142,840 B2
(45) Date of Patent: Oct. 12, 2021

(54) ELECTROFORMING SYSTEM AND METHOD

(71) Applicant: Unison Industries, LLC, Jacksonville, FL (US)

(72) Inventors: Dattu GV Jonnalagadda, Ponnur (IN); Sandeep Kumar, Karnataka (IN); Merin Sebastian, Karnataka (IN); Gordon Tajiri, Waynesville, OH (US); Emily Marie Phelps, Bellbrook, OH (US)

(73) Assignee: Unison Industries, LLC, Jacksonville, FL (US)

( * ) Notice: Subject to any disclaimer, the term of this patent is extended or adjusted under 35 U.S.C. 154(b) by 171 days.

(21) Appl. No.: 16/176,232

(22) Filed: Oct. 31, 2018

(65) Prior Publication Data

US 2020/0131663 A1 Apr. 30, 2020

(51) Int. Cl.

| | |
|---|---|
| ***C25D 17/02*** | (2006.01) |
| ***C25D 21/14*** | (2006.01) |
| ***C25D 3/12*** | (2006.01) |
| ***C25D 1/00*** | (2006.01) |

(52) U.S. Cl.

CPC ..... *C25D 17/02* (2013.01); *C25D 1/00* (2013.01); *C25D 3/12* (2013.01); *C25D 21/14* (2013.01)

(58) Field of Classification Search

None

See application file for complete search history.

(56) References Cited

U.S. PATENT DOCUMENTS

| | | | |
|---|---|---|---|
| 1,845,052 | A | 2/1932 | Laukel |
| 3,498,890 | A | 3/1970 | Divecha et al. |
| 3,617,449 | A | 11/1971 | Cottenham et al. |
| 3,929,592 | A | 12/1975 | Klingenmaier |
| 4,304,641 | A | 12/1981 | Grandia et al. |
| 4,359,375 | A | 11/1982 | Smith |
| 4,434,039 | A | 2/1984 | Baboian et al. |
| 4,441,976 | A | 4/1984 | Iemmi et al. |
| 4,529,486 | A | 7/1985 | Polan |
| 4,534,831 | A | 8/1985 | Inoue |
| 4,853,099 | A | 8/1989 | Smith |
| 4,933,061 | A | 6/1990 | Kulkarni et al. |
| 5,066,379 | A | 11/1991 | Harry et al. |
| 5,421,987 | A | 6/1995 | Tzanavaras et al. |
| 5,516,412 | A | 5/1996 | Andricacos et al. |
| 5,562,810 | A | 10/1996 | Urquhart |
| 5,597,460 | A | 1/1997 | Reynolds |
| 5,837,120 | A | 11/1998 | Forand et al. |
| 5,932,077 | A | 8/1999 | Reynolds |
| 5,958,604 | A | 9/1999 | Riabkov et al. |

(Continued)

FOREIGN PATENT DOCUMENTS

| | | | |
|---|---|---|---|
| CN | 1353779 | A | 6/2002 |
| CN | 105256364 | A | 1/2016 |

(Continued)

*Primary Examiner* — Stefanie S Wittenberg

(74) *Attorney, Agent, or Firm* — McGarry Bair PC

(57) ABSTRACT

An electroforming system and method for electroforming a component includes an electroforming reservoir with a housing defining a fluid passage. An electroforming chamber can be located within the housing and fluidly coupled to the fluid passage via a set of apertures in at least one wall of the electroforming chamber.

19 Claims, 6 Drawing Sheets

(56) References Cited

U.S. PATENT DOCUMENTS

| | | | | |
|---|---|---|---|---|
| 5,976,340 | A | 11/1999 | Sheldon et al. | |
| 6,004,447 | A | 12/1999 | Bischoping et al. | |
| 6,099,702 | A | 8/2000 | Reid et al. | |
| 6,126,798 | A | 10/2000 | Reid et al. | |
| 6,136,163 | A | 10/2000 | Cheung et al. | |
| 6,348,138 | B1 | 2/2002 | Yoshimura et al. | |
| 6,379,511 | B1 | 4/2002 | Fatula et al. | |
| 6,551,472 | B2 | 4/2003 | Saito et al. | |
| 6,761,807 | B2 | 7/2004 | Velez, Jr. et al. | |
| 6,821,407 | B1 | 11/2004 | Reid et al. | |
| 7,112,268 | B2 * | 9/2006 | Okase | C25D 17/06 204/242 |
| 7,566,386 | B2 | 7/2009 | Wilson et al. | |
| 7,837,843 | B2 | 11/2010 | Sharp et al. | |
| 7,931,786 | B2 * | 4/2011 | Wilson | C25D 5/18 204/273 |
| 7,998,323 | B1 * | 8/2011 | Chandra | C25F 3/14 204/224 M |
| 8,262,871 | B1 | 9/2012 | Mayer et al. | |
| 8,980,067 | B2 | 3/2015 | Secherling et al. | |
| 9,249,521 | B2 | 2/2016 | Tomastschger et al. | |
| 9,752,249 | B2 * | 9/2017 | Hiraoka | C25D 5/08 |
| 9,816,194 | B2 | 11/2017 | He et al. | |
| 9,970,120 | B2 | 5/2018 | Tomantschger et al. | |
| 9,988,735 | B2 | 6/2018 | Papapanayiotou et al. | |
| 2004/0016637 | A1 | 1/2004 | Yang et al. | |
| 2004/0134775 | A1 | 7/2004 | Yang et al. | |
| 2004/0226826 | A1 | 11/2004 | Cheng et al. | |
| 2005/0109612 | A1 | 5/2005 | Woodruff et al. | |
| 2006/0131177 | A1 | 6/2006 | Bogart et al. | |
| 2009/0078579 | A1 | 3/2009 | Weibezahn | |
| 2009/0277794 | A1 * | 11/2009 | Trice | C25D 1/20 205/67 |
| 2010/0032303 | A1 | 2/2010 | Reid et al. | |
| 2010/0147679 | A1 | 6/2010 | Feng et al. | |
| 2010/0170801 | A1 | 7/2010 | Metzger | |
| 2017/0243774 | A1 | 8/2017 | Yonehara et al. | |
| 2018/0016688 | A1 | 1/2018 | Angelini | |

FOREIGN PATENT DOCUMENTS

| | | | | |
|---|---|---|---|---|
| CN | 105378154 | A | 3/2016 | |
| CN | 105970258 | A | 9/2016 | |
| CN | 106796963 | * | 5/2017 | H01L 31/04 |
| CN | 106796963 | A | 5/2017 | |
| GB | 2103248 | A | 2/1983 | |
| JP | H05195277 | A | 8/1993 | |

* cited by examiner

ELECTROFORMING SYSTEM AND METHOD

BACKGROUND

An electroforming process can create, generate, or otherwise form a metallic layer of a desired component. In one example of the electroforming process, a mold or base for the desired component can be submerged in an electrolytic liquid and electrically charged. The electric charge of the mold or base can attract an oppositely-charged electroforming material through the electrolytic solution. The attraction of the electroforming material to the mold or base ultimately deposits the electroforming material on the exposed surfaces mold or base, creating an external metallic layer.

BRIEF DESCRIPTION

In one aspect, the disclosure relates to an electroforming reservoir. The electroforming reservoir includes a housing defining a fluid passage, an electroforming chamber within the housing and fluidly coupled to the fluid passage via a set of apertures in at least one wall of the electroforming chamber, and at least one anode located within the electroforming chamber.

In another aspect, the disclosure relates to a system for electroforming a component. The system includes a dissolution reservoir containing an electrolytic fluid and a first anode, a power source electrically coupled to the first anode, and an electroforming reservoir. The electroforming reservoir includes a housing defining a fluid passage fluidly coupled to the dissolution reservoir, an electroforming chamber within the housing and fluidly coupled to the fluid passage via a set of apertures in at least one wall of the electroforming chamber, and at least one second anode located within the electroforming chamber.

In yet another aspect, the disclosure relates to a method of electroforming a component. The method includes supplying an electrolyte solution to a fluid passage in an electroforming reservoir, flowing the electrolyte solution from the fluid passage through a set of apertures to an electroforming chamber having a workpiece and at least one anode, and forming a metal layer on the workpiece to define an electroformed component.

DETAILED DESCRIPTION

Figure 1:
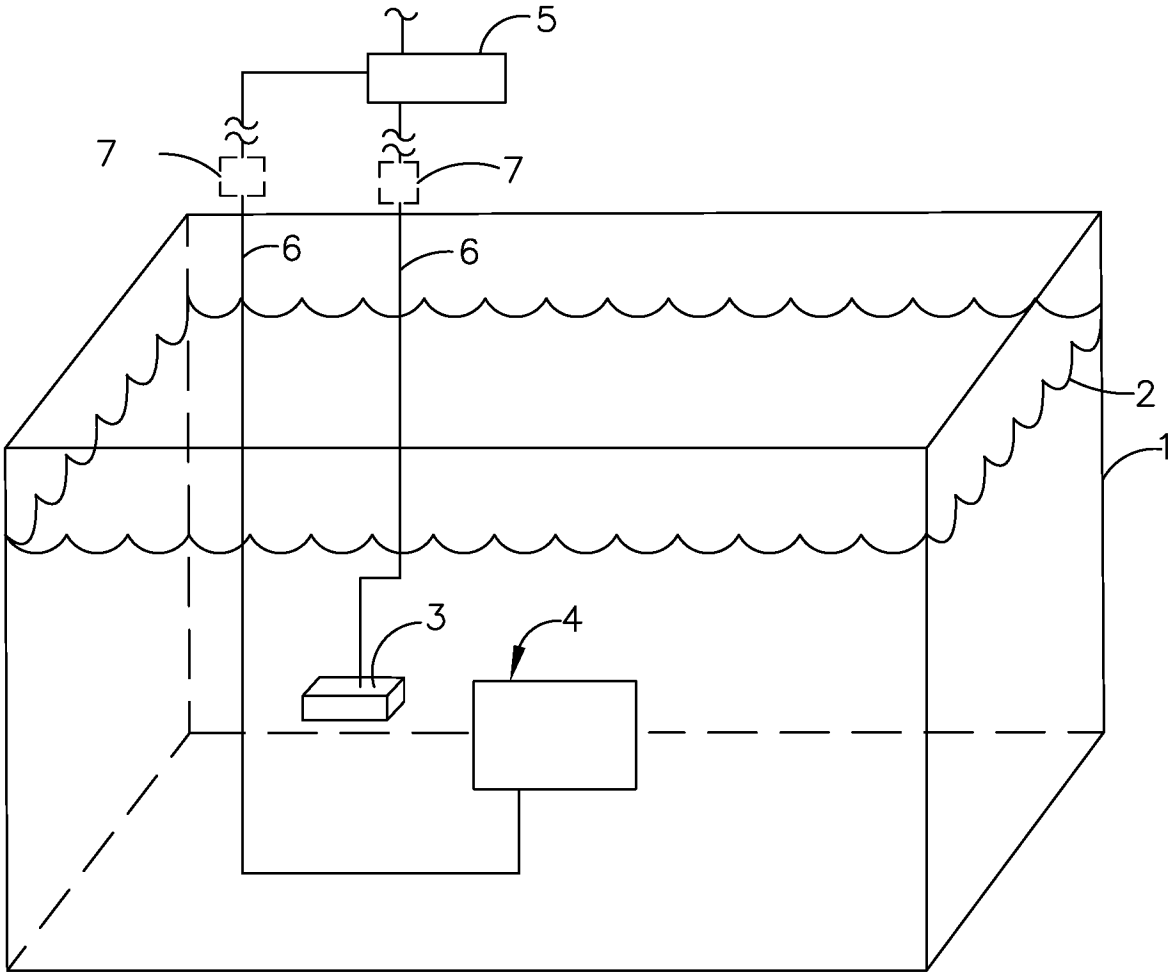
FIG. 1 (PRIOR ART)
FIG. 1 is a schematic view of a prior art electroforming bath for forming a component.

Aspects of the present disclosure are directed to a system and method for electroforming a component. It will be understood that the disclosure can have general applicability in a variety of applications, including that the electroformed component can be utilized in any suitable mobile and non-mobile industrial, commercial, and residential applications.

As used herein, an element described as "conformable" will refer to that element having the ability to be positioned or formed with varying geometric profiles that match or otherwise are similar or conform to another piece. This can include that the element can be conformable strips or moldable elements. In addition, as used herein, "non-sacrificial anode" will refer to an inert or insoluble anode that does not dissolve in electrolytic fluid when supplied with current from a power source, while "sacrificial anode" will refer to an active or soluble anode that can dissolve in electrolytic fluid when supplied with current from a power source. Non-limiting examples of non-sacrificial anode materials can include titanium, gold, silver, platinum, and rhodium. Non-limiting examples of sacrificial anode materials can include nickel, cobalt, copper, iron, tungsten, zinc, and lead. It will be understood that various alloys of the metals listed above may be utilized as sacrificial or non-sacrificial anodes.

All directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. In addition, as used herein "a set" can include any number of the respectively described elements, including only one element.

The exemplary drawings are for purposes of illustration only and the dimensions, positions, order, and relative sizes reflected in the drawings attached hereto can vary.

A prior art electroforming process is illustrated by way of an electrodeposition bath in FIG. 1. As used herein, "electroforming" or "electrodeposition" can include any process for building, forming, growing, or otherwise creating a metal layer over another substrate or base. Non-limiting examples of electrodeposition can include electroforming, electroless forming, electroplating, or a combination thereof. While the remainder of the disclosure is directed to electroforming, any and all electrodeposition processes are equally applicable.

A prior art bath tank 1 carries a single metal constituent solution 2 having alloying metal ions. A soluble anode 3 spaced from a cathode 4 is provided in the bath tank 1. A component to be electroformed can form the cathode 4.

A controller 5, which can include a power supply, can electrically couple to the soluble anode 3 and the cathode 4 by electrical conduits 6 to form a circuit via the conductive single metal constituent solution 2. Optionally, a switch 7 or sub-controller can be included along the electrical conduits 6 between the controller 5, soluble anode 3, and cathode 4. During operation, a current can be supplied from the soluble anode 3 to the cathode 4 to electroform a body at the cathode 4. Supply of the current can cause metal ions from the single metal constituent solution 2 to form a metallic layer over the component at the cathode 4.

In a conventional electroplating process, the soluble anode 3 changes the shape as it dissolves, resulting in variations in the electric field between the soluble anode 3 and the cathode 4. Variations in the shape of the soluble anode 3 result in variations in the thickness of the deposited layer resulting in non-uniform thickness. Also, when the soluble anodes dissolves, particulates are released to the electrolyte. These particulates matter contaminate the cathodic surface for electrodeposition, resulting in non-uniform deposition. While not specifically illustrated, the prior art bath tank 1 can include the conventional technique of reducing particulate contamination from the soluble anode 3 by containing the soluble anode 3 in a porous anode bag. Even though the anode bag prevents large size contaminants being released into the plating solution, it fails to prevent smaller sized particulates from entering the plating solution and contaminating the cathodic plating surface. This results in a non-uniform deposition. Aspects of the present disclosure relate to a conformable non sacrificial anode system where the anode dissolution and the electroforming occurs in separate tanks. The chance of particulates being liberated at the anode dissolution tank reaching the cathode located at the electroforming tank is minimized.

Figure 2:
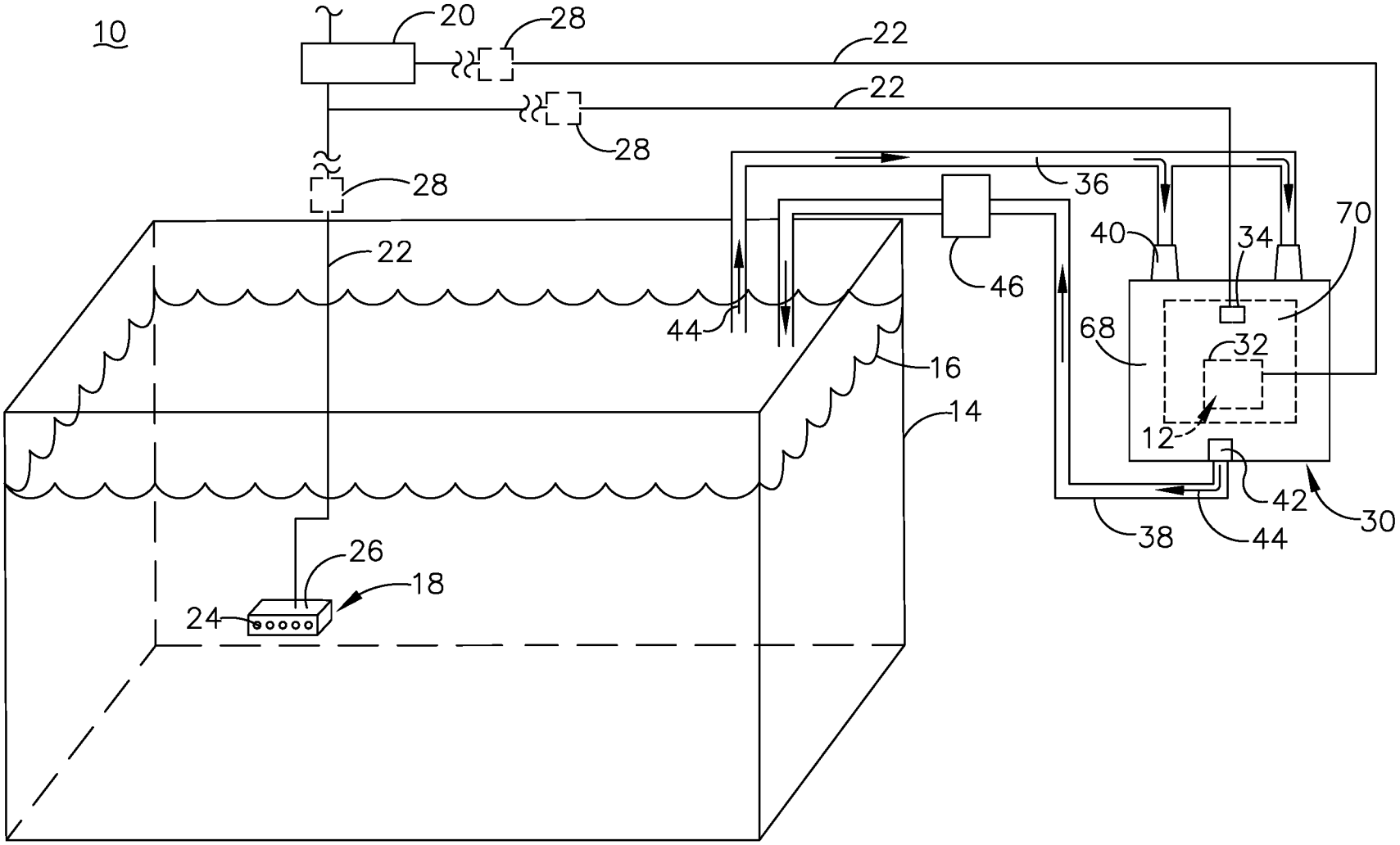
FIG. 2 is a schematic view of a system for electroforming a component according to various aspects of the disclosure.

FIG. 2 illustrates a system 10 for electroforming a component 12 in accordance with various aspects described herein. The system 10 includes a dissolution reservoir 14 containing an electrolytic fluid or electrolyte solution 16. In a non-limiting example the electrolytic fluid 16 can include nickel sulfamate, however, any suitable electrolytic fluid 16 can be utilized. A first anode in the form of a sacrificial anode 18 is located within the dissolution reservoir 14, submerged in the electrolytic fluid 16 and electrically coupled to a power source 20 by way of electrical conduits 22 as shown. It is contemplated that the sacrificial anode 18 can include nickel and cobalt pieces in the form of coins 24 in a porous or mesh bag and placed within a titanium basket 26. The mesh bag can provide for containment of the nickel and cobalt coins 24 as well as any particulate material that may be present within the sacrificial anode 18 while allowing the flow of electrolytic fluid 16 through the sacrificial anode 18.

The power source 20 can also include a controller module to control the flow of current through the electrical conduits 22; alternately, a separate controller may be provided and electrically coupled to the power source 20. In addition, a switch 28 can be provided between the sacrificial anode 18 and power source 20.

An electroforming reservoir 30 electrically coupled to the power source 20 can be included in the system 10. The electroforming reservoir 30 can also be fluidly coupled to the dissolution reservoir 14 by way of an inlet conduit 36 and a drain conduit 38. The electroforming reservoir 30 can be metallic or polymeric and can be formed by any suitable process, including machining or injection molding. The electroforming reservoir 30 can include at least one inlet 40 fluidly coupled to the inlet conduit 36 and at least one outlet 42 fluidly coupled to the drain conduit 38. The electroforming reservoir 30 can include a housing 50 (FIG. 3) defining a fluid passage 68 extending between the at least one inlet 40 and the at least one outlet 42. An electroforming chamber 70 is located within the housing 50. A cathode 32, as well as a second anode in the form of a conformable non-sacrificial anode 34, can both be located within the electroforming chamber 70.

A recirculation circuit 44 can be defined between the dissolution reservoir 14 and the electroforming reservoir 30, wherein electrolytic fluid 16 can flow from the dissolution reservoir 14 through the inlet conduit 36, flow through the electroforming reservoir 30, and flow through the drain conduit 38 back into the dissolution reservoir 14. Optionally, a pump 46 can be fluidly coupled to the recirculation circuit 44 and is schematically illustrated as being positioned along the drain conduit 38 although this need not be the case. The pump 46 can be utilized at any suitable position in the recirculation circuit 44 including at the inlet side of the electroforming reservoir; alternately, multiple pumps 46 can be utilized. In this manner, electrolytic fluid 16 can be supplied from the dissolution reservoir 14 to the electroforming reservoir 30. The electrolytic fluid 16 can be continuously supplied from the dissolution reservoir 14. This can include electrolytic fluid 16 being supplied in discrete portions at regular or irregular time intervals as desired. For example, the pump 46 can be instructed to supply a predetermined volume of electrolytic fluid (e.g. 2.0 liters) to the electroforming reservoir 30 at predetermined time intervals (e.g. every 35 minutes).

Figure 3:
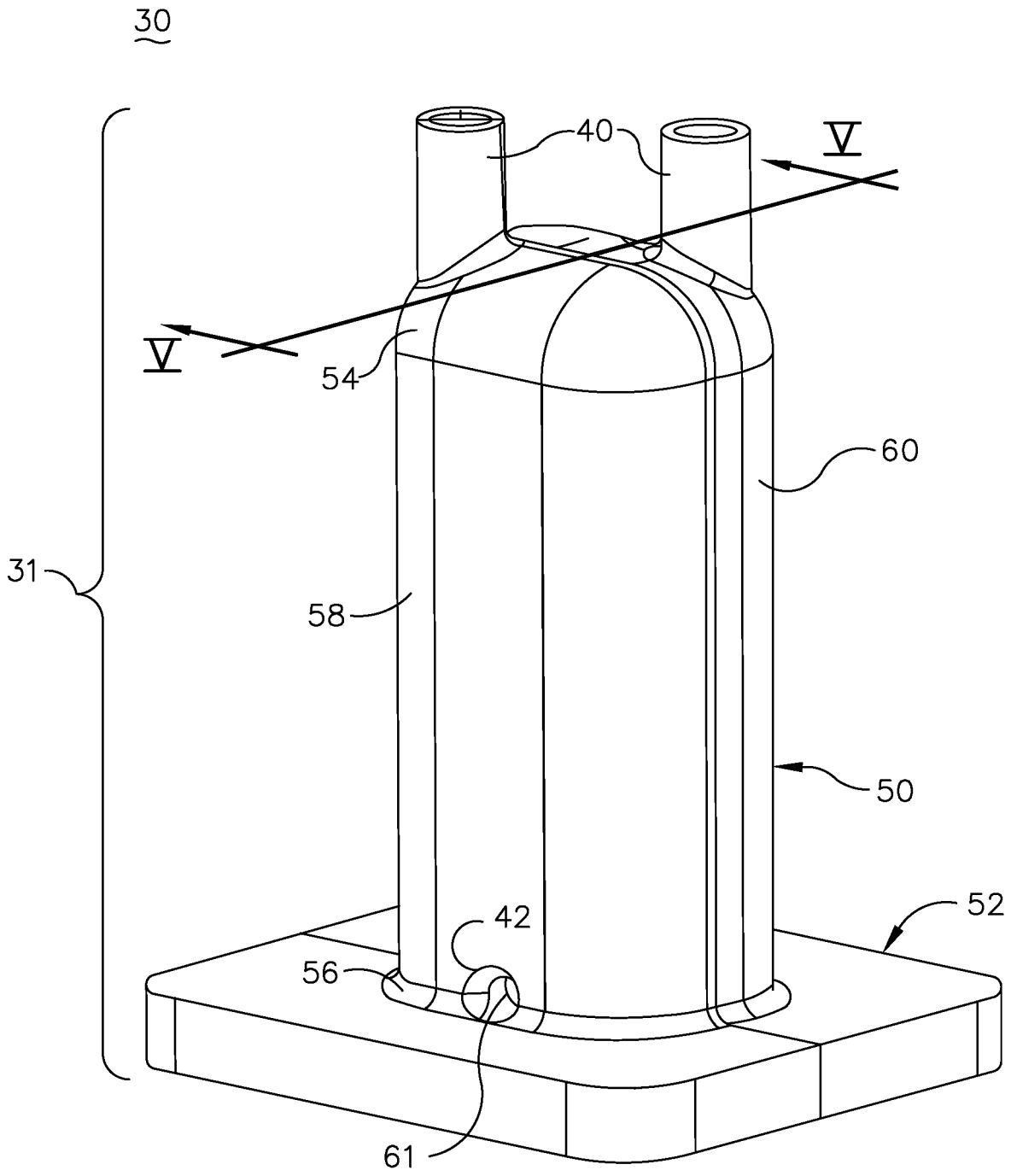
FIG. 3 is a perspective view of an electroforming reservoir that can be utilized in the system of FIG. 2.

FIG. 3 illustrates the housing 50 in further detail including that it can be coupled to a base 52. In the illustrated example two inlets 40 are provided on an upper portion 54 of the housing 50 and one outlet 42 is provided on a transitional portion 56 between the housing 50 and the base 52. It is further contemplated that the electroforming reservoir 30 can be formed as a two-piece body 31 having first and second portions 58, 60 configured to couple together, wherein each portion 58, 60 has a corresponding inlet 40 as shown. The outlet 42 can be formed by a drain opening 61 fluidly coupled to the drain conduit 38 (FIG. 2) and extending into the electroforming reservoir 30. The drain opening 61 and outlet 42 are illustrated in the transitional portion 56; in this manner, the drain opening 61 and outlet 42 can be located at least in the base 52 of the electroforming reservoir 30.

Figure 4:
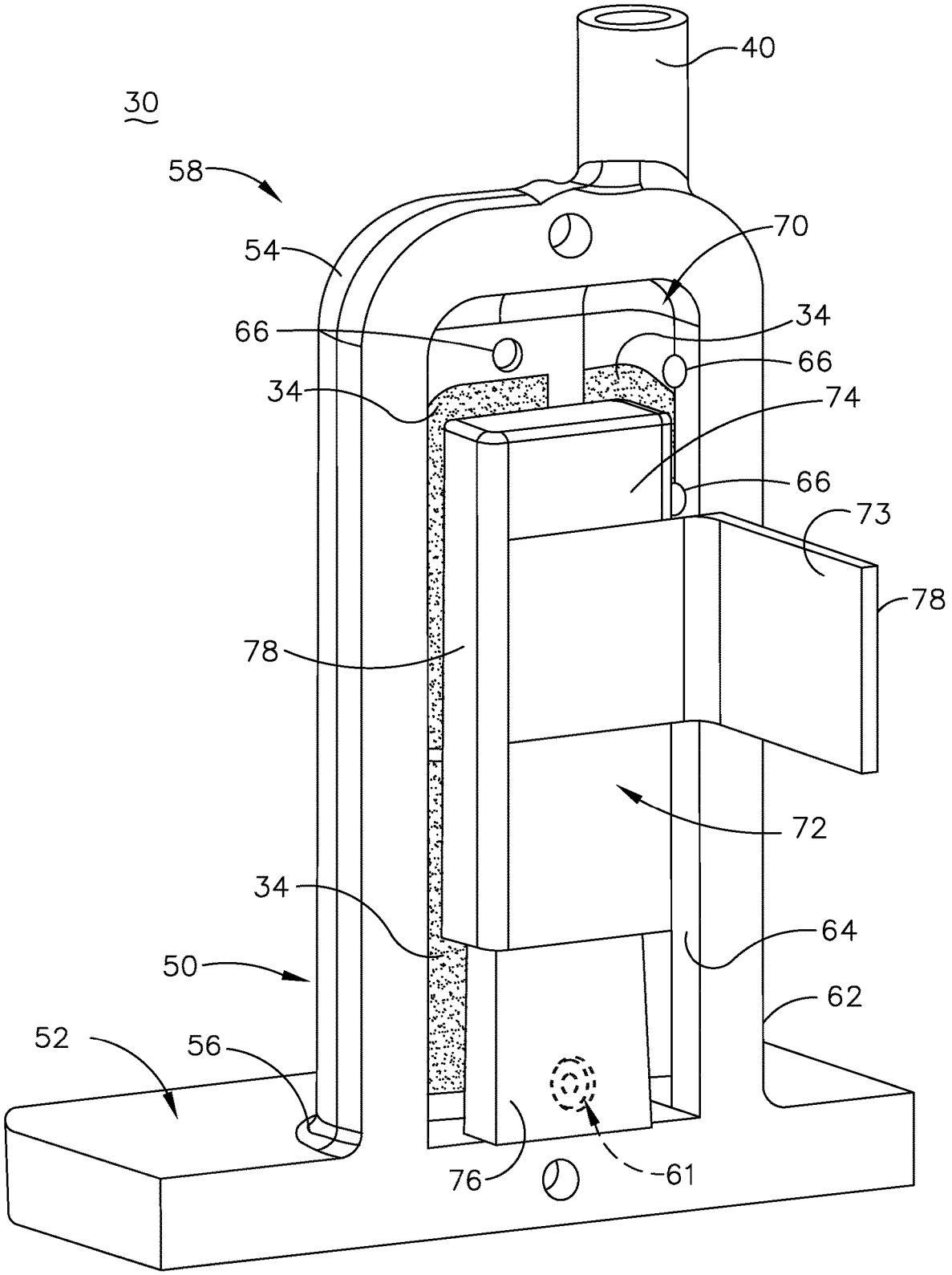
FIG. 4 is a perspective view of a portion of the electroforming reservoir of FIG. 3 containing an electroformed component.

FIG. 4 illustrates the first portion 58 of the electroforming reservoir 30 with the second portion 60 removed for clarity. It will be understood that described aspects and components of the first portion 58 are also applicable to the second portion 60.

The electroforming chamber 70 can be defined by an interior wall 64 within the housing 50. The electroforming chamber 70 is configured to accommodate an exemplary workpiece 72 which is shown as including a bracket 73 coupled to a mandrel 74. A pedestal 76 can be located within the electroforming chamber 70 and configured to receive the workpiece 72 in a predetermined position within the electroforming chamber 70. In the illustrated example, the mandrel 74 can be positioned upon the pedestal 76 such that electrolytic fluid (FIG. 2) can surround as much of the workpiece 72 as possible during the electroforming process. The workpiece 72 can define the cathode 32 electrically coupled to the power source 20 (FIG. 2), such as by way of the electrical conduit 22. For example, the electrical conduit 22 can connect directly to the workpiece 72 such as through an opening (not shown) in the housing 50. Alternately, the electrical conduit 22 and workpiece 72 can be connected to a conductive portion (not shown) of the housing 50.

At least one conformable non-sacrificial anode 34 can be located about at least a portion of a periphery 78 of the workpiece 72. The conformable anode has been illustrated as a plurality of conformable non-sacrificial anodes 34 coupled to the interior wall 64 of the electroforming chamber 70. The conformable non-sacrificial anodes 34 can include any suitable metallic material including titanium strips that can be formed to have the same shape or geometric profile as the workpiece 72 or the interior wall 64.

Figure 5:
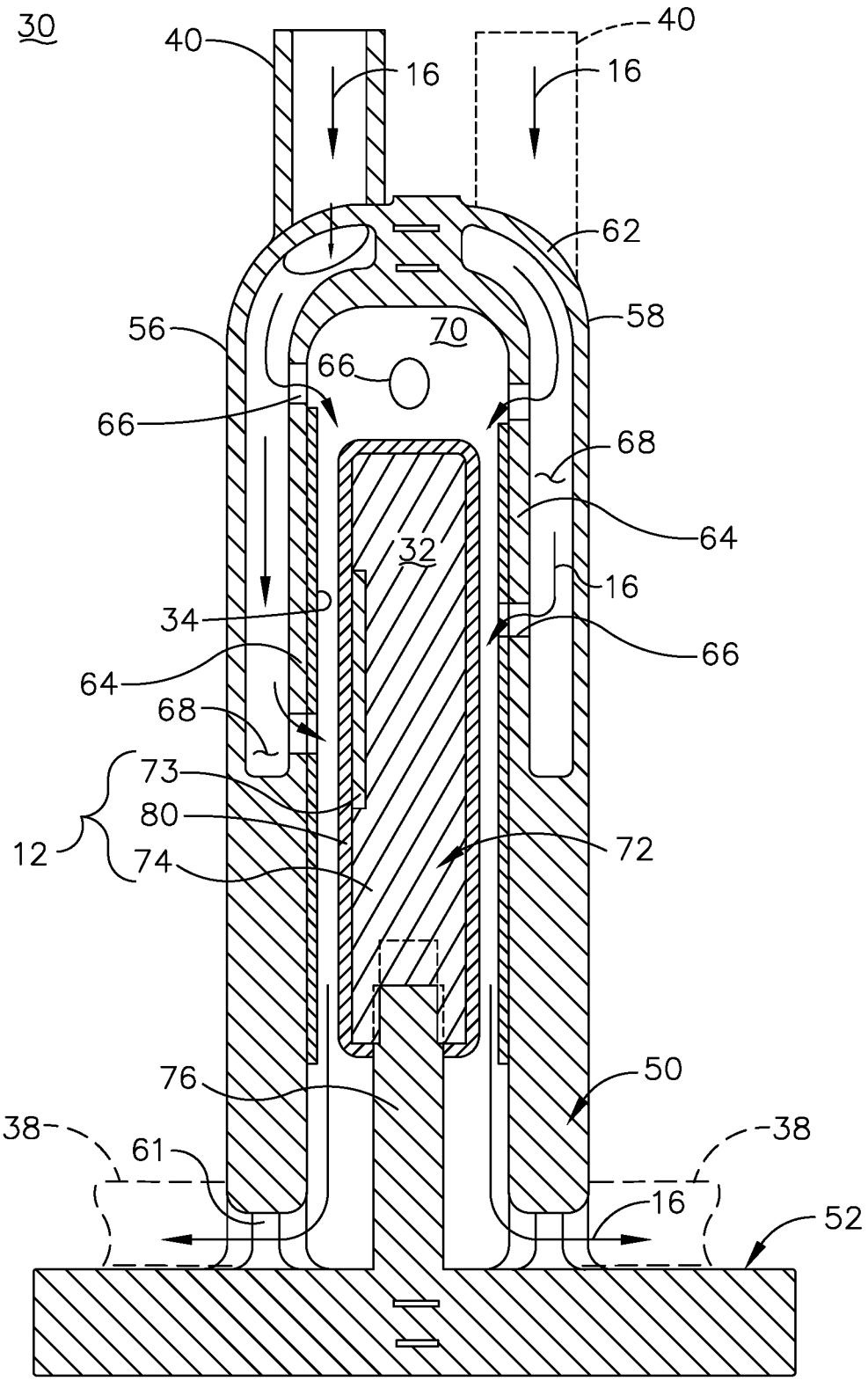
FIG. 5 is a sectional view of the electroforming reservoir of FIG. 3 along line V-V.

FIG. 5 illustrates a cross-sectional view of the electroforming reservoir 30. The inlet 40 on the first portion 58 is shown in cross-section, and the inlet 40 on the second portion 60 is illustrated in phantom. It can be appreciated that coupling the first and second portions 58, 60 together can define the electroforming reservoir 30. An exterior wall 62 and an interior wall 64 having a set of openings or apertures 66 are included in the housing 50. A fluid passage 68 can be defined between the exterior and interior walls 62, 64. The fluid passage 68 can be fluidly coupled to the dissolution reservoir 14 (FIG. 2) by way of the inlet 40. The fluid passage 68 can be formed peripherally around the electroforming chamber 70 via the coupled first and second portions 58, 60. The electroforming chamber 70 can be fluidly coupled to the fluid passage 68 via the set of apertures 66. Arrows illustrate the flow of electrolytic fluid 16 through the inlets 40 into the fluid passage 68 and through the apertures 66 into the electroforming chamber 70. The electroforming chamber 70 can also be fluidly coupled to the drain conduit 38.

A metal layer 80 is shown deposited onto the workpiece 72 to define the electroformed component 12. The metal layer 80 can have a layer thickness that can be tailored based on the apertures 66 directing the flow of electrolytic fluid 16 around the workpiece 72, as well as a spacing distance between the conformable anode 34 and the workpiece 72. In a non-limiting example the metal layer 80 can have a constant layer thickness; in another example, the metal layer 80 can have a variable thickness on different portions of the electroformed component 12.

In operation, the power source 20 supplies current from the sacrificial anode 18 which causes metal ions to enter the electrolytic fluid 16. The electrolytic fluid 16 flows from the dissolution reservoir 14 (FIG. 2) and can be pumped (e.g. via the pump 46) or gravity fed into the electroforming reservoir 30 and the fluid passage 68. The set of apertures 66 can be configured to advance the electrolytic fluid 16 from the fluid passage 68 toward the workpiece 72 in a predetermined direction to form the metal layer 80. Non-limiting examples of predetermined directions include perpendicular to, or orthogonal to, the periphery 78 of the workpiece 72. For example, apertures 66 near the upper portion 54 can direct electrolytic fluid 16 to flow perpendicularly to the top of the workpiece 72 and parallel to the sides of the workpiece 72. Apertures 66 near the center of the housing 50, or near the base 52, can direct electrolytic fluid 16 to perpendicularly impinge the periphery 78 before flowing downward toward the base 52. It can be appreciated that the apertures 66 can also be formed with varying shapes or centerline angles to further direct or tailor the flow of electrolytic fluid 16 around the workpiece 72. For example, the apertures 66 can be shaped to impinge electrolytic fluid 16 at a predetermined velocity upon the workpiece 72, e.g. decreasing a size of an aperture 66 causing an increase in electrolytic fluid velocity impinging upon the workpiece 72. Varying a centerline angle of an aperture 66 can cause the electrolytic fluid 16 to impinge the workpiece 72 at an angle between 0 and 90 degrees, which can provide for a customized thickness of the metal layer 80. The drain openings 61 can then direct the spent electrolytic fluid 16 out of the electroforming chamber 70 and into the at least one outlet 42 and the drain conduit 38 (FIG. 2). The spent electrolytic fluid 16 can recirculate back to the dissolution reservoir 14 (FIG. 2) where additional ions can be added to the electrolytic fluid 16 via the sacrificial anode 18.

Figure 6:
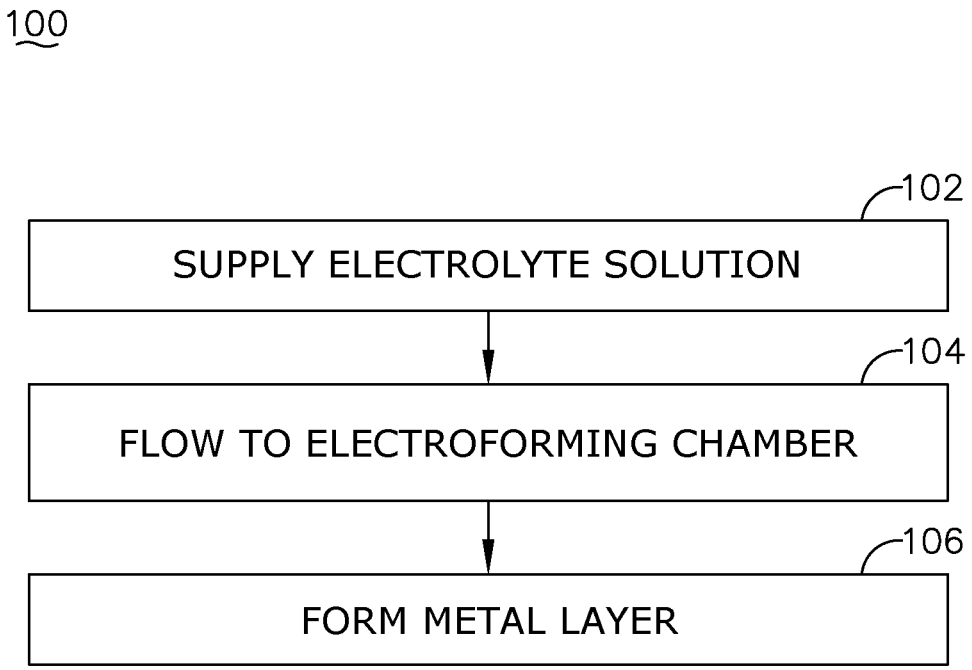
FIG. 6 is a flowchart diagram illustrating a method of electroforming a component according to various aspects of the disclosure.

FIG. 6 is a flowchart illustrating a method 100 of electroforming a component, such as the component 12. At 102, the method 100 includes supplying the electrolyte solution to a fluid passage, such as the fluid passage 68 in the electroforming reservoir 30. Optionally, the supplying can include supplying the electrolyte solution from the fluid reservoir to the chamber 70 within the electroforming reservoir 30, which includes a workpiece 72 and at least one non-sacrificial anode 34. At 104, the method 100 includes flowing the electrolyte solution from the fluid passage 68 through the set of apertures 66 to the electroforming chamber 70 having the workpiece 72 and the at least one non-sacrificial anode 34. At 106, the method 100 includes forming a metal layer 80 on the workpiece 72 to define an electroformed component 12. This can include locating conformable anodes about the workpiece 72 and impinging the electrolyte solution upon the workpiece 72 within the electroforming chamber 70, such as impinging with at least one of a predetermined velocity or a predetermined direction. Optionally, the method can further include draining the spent electrolyte solution, such as being pumped or gravity fed, from the electroforming chamber as described above. Optionally, the method 100 can include generating, via the power source 20, electrolytes within a solution in a fluid reservoir, such as the dissolution reservoir 14, by supplying electrical power to the sacrificial anode 18 to define an electrolytic solution such as electrolytic fluid 16. This can include dissolving nickel and cobalt ions in a nickel sulfamate solution and either continuously or discontinuously supplying the electrolytic fluid 16 from the fluid reservoir such as the dissolution reservoir 14, or continuously circulating the electrolytic fluid 16 through the recirculation circuit 44.

Aspects of the present disclosure provide for a variety of benefits including that locating a sacrificial anode in a separate tank or reservoir from the cathode can greatly reduce the chance of particulate matter reaching the cathode in the separate electroforming reservoir and therefore reduce any undesired irregularities in the electroformed component. Another advantage is that the set of apertures in the electroforming reservoir can be utilized to provide a variety of "throw angles" or impingement angles of the electrolyte solution on the workpiece. Such tailoring of throw angles can improves the coverage of electrolyte solution over hard to reach areas of the workpiece, as well as provide for custom metal layer thickness at various regions of the electroformed component. It can also be appreciated that tailoring an impingement angle in combination with a flow rate or speed onto the workpiece can further provide for customized metal layer thicknesses at various regions of the electroformed component.

Yet another advantage is that the electroforming reservoir can be configured to accommodate a wide variety of shapes and sizes for different workpieces. For example, the multiple-piece electroforming reservoir can be injection molded with any desired shape to accommodate brackets, duct sections, hardware, or manifolds, in non-limiting examples. In addition, another advantage is that multiple electroforming reservoirs can be fluidly coupled to a common dissolution reservoir such that multiple components can be simultaneously electroformed in their respective electroforming chambers. This can increase production speed and improve process efficiencies during formation of the electroformed components. Separation of the electroformed component and the dissolution reservoir can also provide for a less populated working area; e.g. small workpieces can be positioned in small reservoirs, and large workpieces within large reservoirs, instead of a small workpiece placed within a large electroforming bath tank. Still another advantage can be realized in that adjustment of the sacrificial anode or components within the dissolution reservoir can be more easily accomplished without disturbing the electroforming reservoirs or cathodes therein.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electroforming reservoir, comprising:

a body having a first portion and a second portion operably coupled to form an electroforming chamber with a fluid passage formed peripherally around the electroforming chamber, the body defining a housing including the first portion and the second portion, each of the first portion and the second portion having an exterior wall and an interior wall spaced apart from the exterior wall to define a portion of the fluid passage, when the first portion and the second portion are operably coupled a housing exterior wall and a housing interior wall are defined, the housing interior wall further defining the electroforming chamber radially interior of the housing interior wall, the housing interior wall at least partially separating the electroforming chamber from the fluid passage;

a set of apertures in the housing interior wall fluidly coupling the fluid passage and the electroforming chamber; and anodes operably coupled to the housing interior wall within the electroforming chamber.

2. The electroforming reservoir of claim 1 wherein the electroforming chamber is configured to receive a workpiece defining a cathode.

3. The electroforming reservoir of claim 2, further comprising a pedestal located within the electroforming chamber and configured to receive the workpiece in a predetermined position within the electroforming chamber.

4. The electroforming reservoir of claim 1 wherein the anodes located within the electroforming chamber comprise non-sacrificial anodes.

5. The electroforming reservoir of claim 4 wherein the non-sacrificial anodes are conformable about a workpiece located within the electroforming chamber.

6. The electroforming reservoir of claim 5 wherein the conformable non-sacrificial anodes comprise titanium strips.

7. The electroforming reservoir of claim 1, further comprising at least one drain opening in a base of the electroforming reservoir and fluidly coupled to the electroforming chamber.

8. The electroforming reservoir of claim 2 wherein the set of apertures are configured to advance fluid towards the workpiece in a predetermined direction.

9. The electroforming reservoir of claim 1 wherein the electroforming reservoir comprises a two-piece body configured to couple together to form the fluid passage and electroforming chamber.

10. The electroforming reservoir of claim 1, wherein the anodes coupled to the housing interior wall are formed to have the same geometric profile as the housing interior wall.

11. A system for electroforming a component, comprising:

a dissolution reservoir containing an electrolytic fluid and a first anode;

a power source electrically coupled to the first anode; and an electroforming reservoir, comprising:

a body having a first portion and a second portion operably coupled to form an electroforming chamber with a fluid passage formed peripherally around the electroforming chamber, the body defining a housing including the first portion and the second portion, each of the first portion and the second portion having an exterior wall and an interior wall spaced apart from the exterior wall to define a portion of the fluid passage, when the first portion and the second portion are operably coupled a housing exterior wall and a housing interior wall are defined, the housing interior wall further defining the electroforming chamber radially interior of the housing interior wall, the housing interior wall at least partially separating the electroforming chamber from the fluid passage;

a set of apertures in the housing interior wall fluidly coupling the fluid passage and the electroforming chamber; and at least one second anode coupled to the housing interior wall within the electroforming chamber, with the at least one second anode formed to have the same geometric profile as the housing interior wall.

12. The system of claim 11 wherein the first anode comprises a sacrificial anode including at least one of nickel or cobalt coins, the at least one second anode comprises titanium strips, and the electrolytic fluid comprises nickel sulfamate.

13. The system of claim 11, further comprising an inlet conduit and a drain conduit at least partially defining a recirculation circuit between the dissolution reservoir and the electroforming chamber.

14. The system of claim 13, further comprising a pump fluidly coupled to the recirculation circuit.

15. The system of claim 11 wherein the at least one second anode is electrically coupled to the power source.

16. A method of electroforming a component in the system of claim 11, the method comprising:

supplying the electrolytic fluid to the fluid passage in the electroforming reservoir;

flowing the electrolytic fluid from the fluid passage through the set of apertures in the housing interior wall to the electroforming chamber having a workpiece and the at least one second anode along the housing interior wall; and forming a metal layer on the workpiece to define an electroformed component.

17. The method of claim 16 wherein the supplying the electrolytic fluid includes continuously supplying the electrolytic fluid from the dissolution reservoir fluidly coupled to the electroforming reservoir.

18. The method of claim 17 wherein a recirculation circuit fluidly couples the dissolution reservoir and the electroforming chamber and the supplying the electrolytic fluid includes continuously circulating the electrolytic fluid through the recirculation circuit.

19. The method of claim 16 wherein supplying the electrolytic fluid to the electroforming chamber includes impinging the electrolytic fluid upon the workpiece within the electroforming chamber.

* * * * *